United States Patent [19]

Sameshima et al.

[11] Patent Number: 4,736,598

[45] Date of Patent: Apr. 12, 1988

[54] OUTDOOR UNIT OF AIR CONDITIONER

[75] Inventors: Kouichi Sameshima, Fuji; Kazuhiro Moriyama, Fujinomiya, both of Japan

[73] Assignee: Kabushiki Kaisha Toshiba, Kawasaki, Japan

[21] Appl. No.: 29,770

[22] Filed: Mar. 24, 1987

[30] Foreign Application Priority Data

Mar. 25, 1986 [JP] Japan ..... 60-66272

[51] Int. Cl.[4] ..... F25D 23/12

[52] U.S. Cl. ..... 62/259.1; 62/448

[58] Field of Search ..... 62/449, 450, 259.1, 62/448

[56] References Cited

U.S. PATENT DOCUMENTS 3,740,964 6/1973 Herweg ..... 62/448 X
4,138,859 2/1979 Pietsch ..... 62/259.1 X
4,641,503 2/1987 Kobayashi ..... 62/259.1

FOREIGN PATENT DOCUMENTS 47-22781 7/1972 Japan .
57-28049 6/1982 Japan .
60-18775 6/1985 Japan .

*Primary Examiner*—Lloyd L. King
*Attorney, Agent, or Firm*—Cushman, Darby & Cushman

[57] ABSTRACT

An outdoor unit of an air conditioner includes a box-shaped casing. The interior of the casing is divided into an upper chamber and a lower chamber by a first partition wall which is arranged in parallel with the top and bottom walls of the casing. The lower chamber is divided into a heat exchanger chamber and a machine chamber by a second partition wall extending perpendicular to the bottom wall. A heat exchanger and a compressor are arranged in the heat exchanger chamber and machine chamber, respectively. Electric parts are arranged in the upper chamber and located above the heat exchanger chamber. A support rod is located in the heat exchanger chamber and fixed at one end to the first partition wall and at the other end to the bottom wall. A blower is attached to the support rod and faces the heat exchanger.

3 Claims, 4 Drawing Sheets

OUTDOOR UNIT OF AIR CONDITIONER

BACKGROUND OF THE INVENTION

This invention relates to an outdoor unit belonging to an air conditioner involving separate indoor and outdoor units.

In general households, a separate type air conditioner is widely accepted which is easily set in place and occupies a very small indoor space. This type of air conditioner involves indoor and outdoor units. These units communicate with each other by means of a coolant pipe and are also electrically connected to each other.

An outdoor unit usually comprises a box-shaped casing provided with top and bottom plates and a plurality of side walls. The casing is divided into right and left compartments by means of a main partitioning board erected on the bottom wall. One compartment constitutes a heat exchanger chamber. The other compartment is further divided by an auxiliary partition wall into a machine chamber and a chamber for electric parts, positioned above the machine chamber. Received in the heat exchanger chamber are an outdoor heat exchanger and a blower set opposite to the heat exchanger. The blower is fitted to the free end of a support rod erected on the bottom wall. The machine chamber holds a compressor and the electric parts chamber contains electric implements for controlling the operation of the blower and compressor.

With the outdoor unit constructed as described above, the blower is set on a support rod erected on the bottom wall, whose lower end alone is fixed to the casing of the outdoor unit. When, therefore, the blower is driven, the support rod tends to be shaken. The shaking motion is transmitted to the bottom wall of the casing, causing noise. For the reliable suppression of the vibrations, it is necessary to increase the thickness of the support rod and bottom wall and increase the mechanical strength of the support rod and bottom wall. However, such improvements are accompanied with the drawback that the cost of parts increases and more manufacturing steps have to be taken.

Since the casing is constructed by a plurality of members such as the top, bottom and side walls, it is low in mechanical strength. Further, the compressor held in the machine chamber generates heat when put into operation. The heat is collected in the upper portion of the machine chamber and undesirably heats the auxiliary partition wall. As a result, the electric parts in the electric parts chamber located above the machine chamber are harmfully affected, decreasing the reliability of the air conditioner as a whole.

SUMMARY OF THE INVENTION

This invention has been accomplished in view of the above-mentioned circumstances, and is intended to provide an outdoor unit of an air conditioner, which elevates the mechanical strength of the casing and reduces the harmful thermal effect on the electric parts without being accompanied with a rise in the manufacturing cost.

To attain the above-mentioned object, this invention provides an air conditioner outdoor unit which comprises:

a box-shaped casing which includes a bottom wall, top wall and a plurality of side walls, and is provided with a first partition wall arranged in the casing substantially parallel with the bottom and top walls, for dividing the interior of the casing into an upper chamber facing the top wall and a lower chamber facing the bottom wall, and a second partition wall arranged in the lower chamber substantially perpendicular to the bottom wall, for dividing the lower chamber into a heat exchanger chamber, said second partition wall being fixed to said first partition wall on a first end surface and being fixed to said bottom wall on a second end surface so that said first and second partition walls form a "T" and a machine chamber;

a heat exchanger arranged in the heat exchanger chamber;

a blowing unit arranged in the heat exchanger chamber, the blowing unit including a support member having one end fixed to the bottom wall and the other end fixed to the first partition wall, and a blower attached to the support member and facing the heat exchanger;

a compressor installed in the machine chamber; and electrical parts arranged in the upper chamber and positioned above the heat exchanger chamber, for controlling the operation of the blower and compressor.

BRIEF DESCRIPTION OF THE DRAWINGS

FIGS. 4 to 6 show an outdoor unit according to a third embodiment of the invention: in which FIG. 4 is an exploded perspective view of the outdoor unit; FIG. 5 is a longitudinal sectional view of the outdoor unit; and FIG. 6 is a partially broken perspective view of the outdoor unit.

DETAILED DESCRIPTION OF THE PREFERRED EMBODIMENTS

Embodiments of the present invention will now be described in detail with reference to the accompanying drawings.

Figure 1:
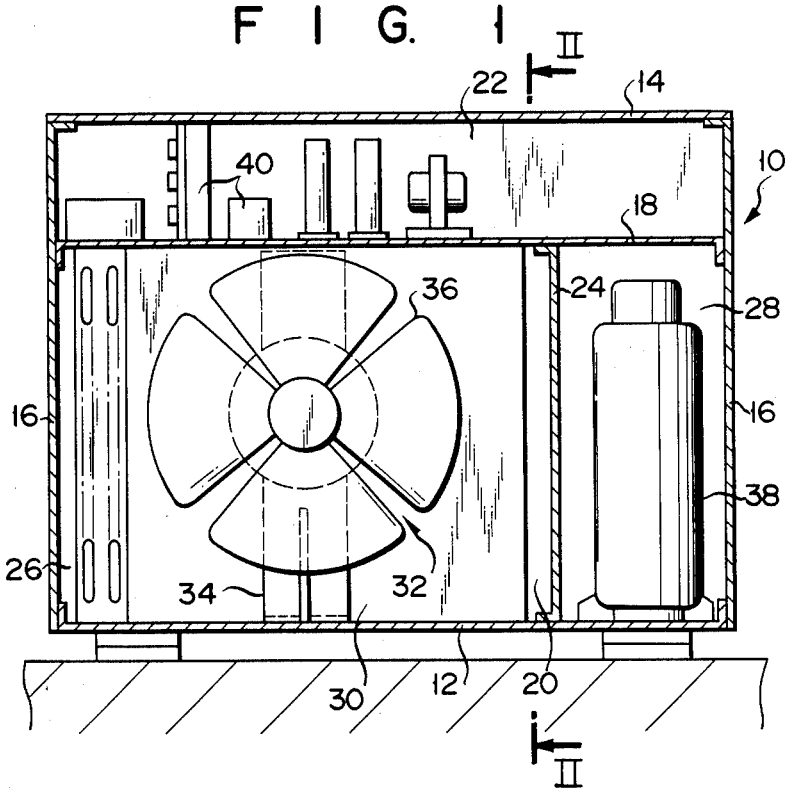
FIG. 1 is a longitudinal sectional view of an outdoor unit according to a first embodiment of the present invention.
Figure 2:
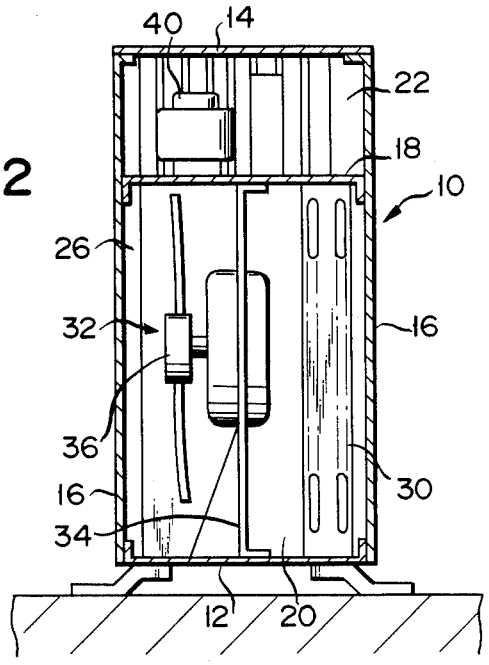
FIG. 2 is a sectional view taken along a line II—II in FIG. 1.

Referring to FIGS. 1 and 2, an outdoor unit is provided with a box-shaped casing 10. Casing 10 comprises bottom wall 12, top wall 14 and four side walls 16. In casing 10, first partition wall 18 is fixed to four side walls 16 in parallel with bottom wall 12 and top wall 14. The interior of casing 10 is divided by partition wall 18 into lower chamber 20 facing bottom wall 12 and upper chamber 22 facing top wall 14. Provided in lower chamber 20 is second partition wall 24 erected on bottom wall 12. Second partition wall 24 is fixed at its lower end to bottom wall 12 and at its upper end to first partition wall 18. As a result, lower chamber 20 is separated by partition wall 24 into heat exchanger chamber 26 and machine chamber 28.

Heat exchanger chamber 26 contains heat exchanger 30 and blowing unit 32 for directing air streams to heat exchanger 30. Unit 32 includes support rod 34 and blower 36 attached to support rod 34 and facing heat exchanger 30. Support rod 34 is formed of a metal plate having a predetermined thickness, and is bent at right angles at the upper and lower ends. Support rod 34 has a length corresponding to the height of heat exchanger chamber 26, namely, a distance between bottom wall 12 and first partition wall 18. The upper and lower ends of support rod 34 are respectively fixed to first partition plate 18 and bottom wall 12 by spot welding or another known method. Thus, support rod 34 extends perpendicular to bottom wall 12 and partition wall 18 and occupies a substantially central position of heat exchanger chamber 26.

When compressor 38 is put into operation, a coolant is compressed. The compressed coolant flows through heat exchanger 30 and the heat exchanger (not shown) of an indoor unit, thereby effecting the heating or cooling of a room. At this time blower 36 is driven to send external air streams into heat exchanger 30, thereby assisting the heat-exchanging function of heat exchanger 30.

The outdoor unit constructed as described above offers the following advantages. Securely set in casing 10 are first partition wall 18 parallel with bottom wall 12 and support rod 34 erected on bottom wall 12. As viewed from the front and side planes of casing 10, partition wall 18 and support rod 34 form a T-shaped frame and reinforce casing 10, thus increasing the mechanical strength of casing 10. Further, support rod 34 whose top and bottom ends are respectively fixed to first partition wall 18 and bottom wall 12 of casing 10, thereby offers greater support strength. Consequently, vibrations arising from the drive of blower 36 can be effectively minimized.

During the operation of the subject air conditioner, heat generated by compressor 38 is collected in the upper portion of machine chamber 28. However, electric parts 40 are positioned above heat exchanger chamber 26 and apart from machine chamber 28. Accordingly, they are little affected by heat, thus providing a highly reliable outdoor unit for an air conditioner.

Figure 3:
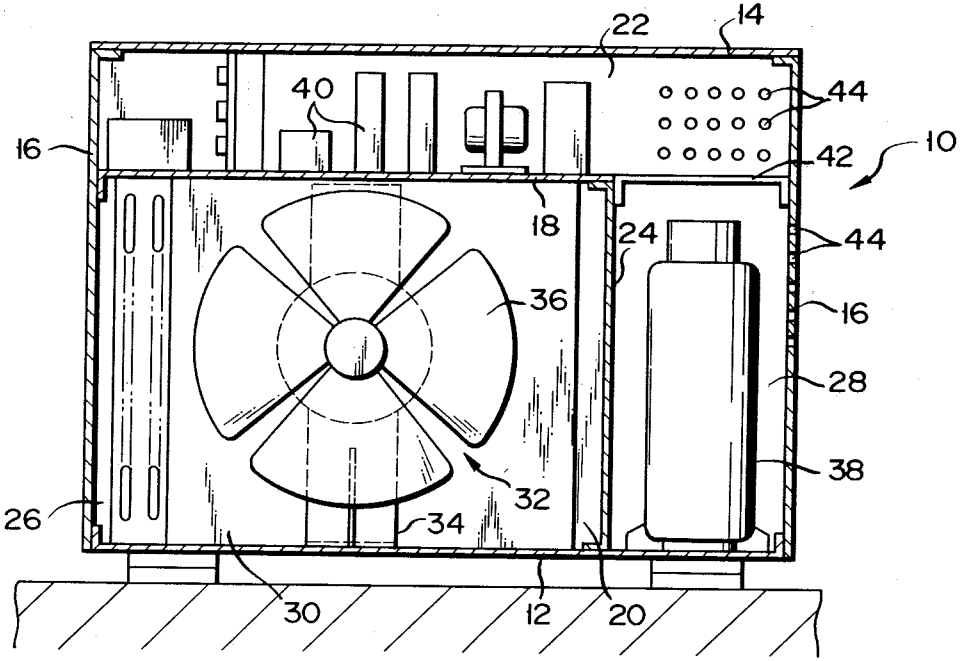
FIG. 3 is a longitudinal sectional view of an outdoor unit according to a second embodiment of the invention.

Description may now be made with reference to FIG. 3 of an air conditioner outdoor unit according to a second embodiment of the present invention. First partition wall 18 has opening 42 communicating with machine chamber 28. Side walls 16, adjacent to compressor 38, are provided with a large number of cooling ports 44. In other respects, the outdoor unit has substantially the same arrangement as that of the first embodiment, and the same parts of the outdoor unit of the second embodiment are indicated by the same reference numerals, description thereof being omitted.

The above-mentioned second embodiment also offers the advantages that casing 10 and support rod 34 are increased in mechanical strength, and heat released from the compressor is discharged out of casing through cooling ports 44, thereby preventing the subject outdoor unit from being damaged by the heating of electric parts 40 which might otherwise take place.

Figure 4:
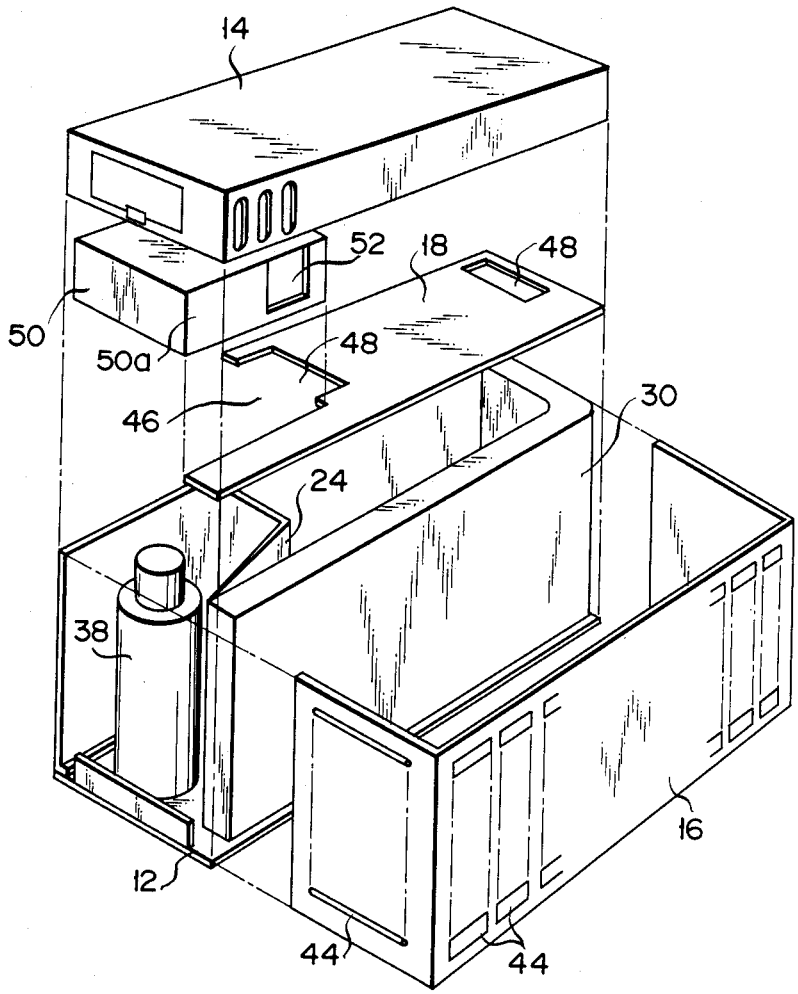
Figure 5:
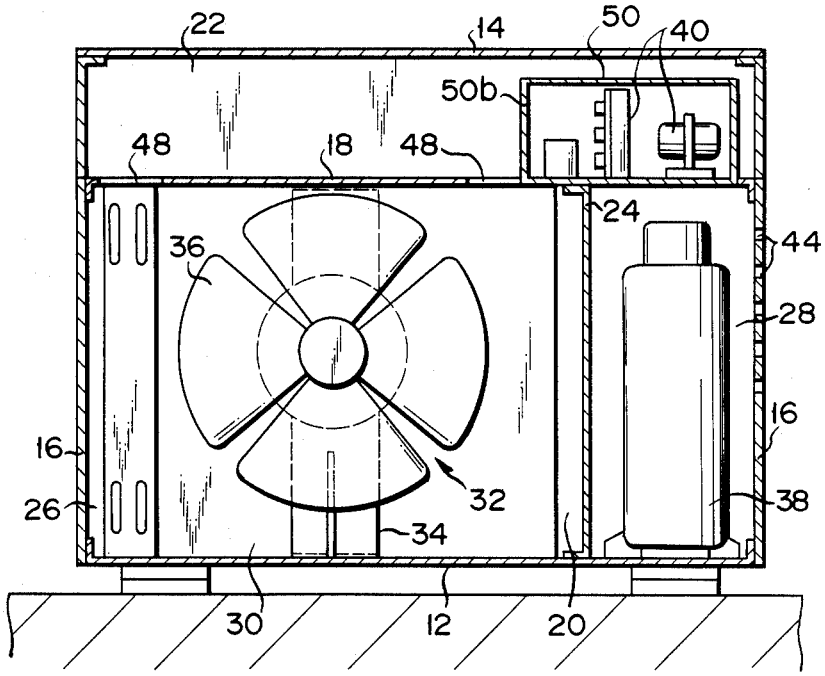
Figure 6:
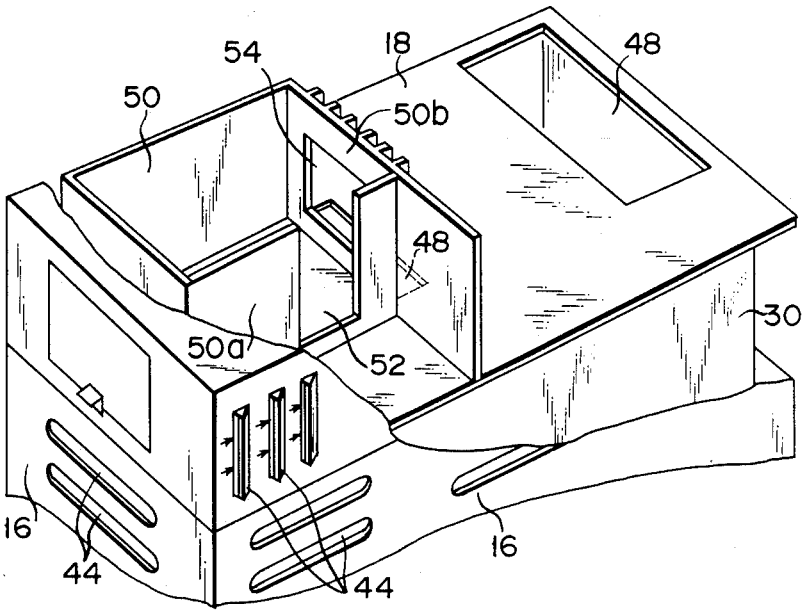

Description may now be made with reference to FIGS. 4 to 6 of an air conditioner outdoor unit according to a third embodiment of the present invention. In the third embodiment, first partition wall 18 is provided with notch 46 communicating with machine chamber 28 and a pair of ports 48 communicating with heat exchanger chamber 26. A plurality of electric parts 40 are received in storage box 50. This box 50 is securely fitted into notch 46 formed in partition wall 18. Side wall **50*a* of storage box 50 which faces back side 16 of casing 10 is provided with cooling air inlet port 52. Side wall 50*b* of storage box 50 which faces heat exchanger chamber 26 is provided with cooling air discharge port 54. Side wall 16 of casing 10 is provided with numerous cooling ports 44 communicating with heat exchanger chamber 26, machine chamber 28 and upper chamber 22** of the outdoor unit.

The outdoor unit arranged as described above offers the advantages that when compressor 38 and blower 36 are driven at the same time, external cooling air is carried into casing 10 through cooling ports 44 of side walls 16. Cooling air drawn into heat exchanger chamber 26 flows through heat exchanger 30 and assists its heat exchange function. Cooling air carried into upper chamber 22 flows through inlet port 52 into storage box 50 to cool electric parts 40 held therein. Cooling air whose temperature is now increased is conducted into heat exchanger chamber 26 through outlet port 54, upper chamber 22 and conduction ports 48. The air introduced into chamber 26 is drawn out of casing 10 together with the cooling air which cools heat exchanger 30 and whose temperature has now increased.

The outdoor unit according to the third embodiment offers the advantages that as in the first embodiment, the thermal damage of the electric parts can be suppressed; the mechanical strength of the casing is improved; and vibration resulting from the drive of the blower can be minimized.

What is claimed is:

1. An air conditioner outdoor unit comprising:

a box-shaped casing including a bottom wall, top wall and a plurality of side walls, said casing having a first partition wall which is set in the casing substantially in parallel with the bottom wall and top wall to divide the casing interior into an upper chamber, facing top wall, and a lower chamber, facing the bottom wall, and a second partition wall which is built in the lower chamber substatially perpendicular to the bottom wall to divide the lower chamber into a heat exchanger chamber and machine chamber, said second partition wall being fixed to said first partition wall on a first end surface and being fixed to said bottom wall on a second end surface so that said first and second partition walls form a "T";

a heat exchanger arranged in the heat exchanger chamber;

a blowing unit arranged in the heat exchanger chamber, the unit including a support member having one end fixed to the bottom wall and the other end fixed to the first partition wall, and a blower attached to the support member and facing the heat exchanger;

a compressor installed in the machine chamber; and electric parts arranged in the upper chamber and positioned above the heat exchanger chamber, for controlling the operation of the blower and compressor.

2. An air conditioner outdoor unit according to claim 1, wherein said support member extends substantially perpendicular to the first partition wall.

3. An air conditioner outdoor unit according to claim 1, wherein said first partition wall is provided with an opening communicating with the machine chamber; and the casing includes a large number of cooling ports formed on the side walls in communication with the machine chamber and the upper chamber.

* * * * *

UNITED STATES PATENT AND TRADEMARK OFFICE

CERTIFICATE OF CORRECTION

PATENT NO. : 4,736,598

DATED : Apr 12, 1988

INVENTOR(S) : Kouichi SAMESHIMA, Kazuhiro MORIYAMA

It is certified that error appears in the above-identified patent and that said Letters Patent is hereby corrected as shown below:

Title page:

FOREIGN APPLICATION PRIORITY DATA:

Please Change

"60-66272" to

--61-66272--

Signed and Sealed this

Twenty-ninth Day of November, 1988

*Attest:*

DONALD J. QUIGG

*Attesting Officer*

*Commissioner of Patents and Trademarks*